US008678960B2

(12) United States Patent
Bierfreund

(10) Patent No.: US 8,678,960 B2
(45) Date of Patent: Mar. 25, 2014

(54) ARROWHEAD WITH ELONGATED TENTACLES

(76) Inventor: Karl-Heinz Bierfreund, Ober-Ramstadt (DE)

( * ) Notice: Subject to any disclaimer, the term of this patent is extended or adjusted under 35 U.S.C. 154(b) by 0 days.

(21) Appl. No.: 13/474,256

(22) Filed: May 17, 2012

(65) Prior Publication Data

US 2013/0244818 A1 Sep. 19, 2013

(30) Foreign Application Priority Data

Mar. 19, 2012 (DE) ..... 10 2012 005 318

(51) Int. Cl.
*F42B 6/08* (2006.01)

(52) U.S. Cl.
USPC ..... 473/583

(58) Field of Classification Search
USPC ..... 473/578, 582, 583, 584
See application file for complete search history.

(56) References Cited

U.S. PATENT DOCUMENTS

| | | | | |
|---|---|---|---|---|
| 3,027,153 | A * | 3/1962 | Zwickey | 267/154 |
| 3,241,836 | A | 3/1966 | Zwickey | |
| 4,471,962 | A | 9/1984 | Gofrey | |
| 5,022,658 | A * | 6/1991 | Burkhart | 473/578 |
| 7,311,622 | B1 * | 12/2007 | Futtere | 473/583 |
| 2006/0089216 | A1 | 4/2006 | Monteleone | |
| 2009/0029811 | A1 | 1/2009 | Bolen, III | |

OTHER PUBLICATIONS

Pfufungsstelle Fur Klasse, "German Patent Application No. 10 2012 005 318.5 Office Action", Aug. 22, 2012, Published in: DE.

* cited by examiner

*Primary Examiner* — John Ricci
(74) *Attorney, Agent, or Firm* — Kaplan Breyer Schwarz & Ottesen, LLP

(57) ABSTRACT

The invention concerns an arrowhead with elongated tentacles, each of which forms two ends, each tentacle being fastened with one end to the arrowhead and the other end being unsupported, and in which each tentacle, starting from the fastening on the arrowhead, leaves it in the direction of the free end so that an angle of ≥0° and less than 90° is formed between the longitudinal axis of the arrowhead in the flight direction and the tentacle.

19 Claims, 2 Drawing Sheets

ARROWHEAD WITH ELONGATED TENTACLES

CROSS-REFERENCE TO RELATED APPLICATIONS

Patent application DE 10 2012 005 318.5, filed on Mar. 19, 2012, is incorporated herein by reference.

FIELD OF INVENTION

The invention concerns an arrowhead with elongated tentacles.

BACKGROUND OF THE INVENTION

The invention starts from a prior art, according to which arrows that are shot from bows or also crossbows are essentially constructed from arrowheads and arrow shafts.

The arrowhead of such an arrow can be permanently joined to an arrow shaft or also inserted replaceably in an arrow shaft, in which case insertion of the arrowhead can also occur by screwing the arrowhead into the arrow shaft or into a separate insert, which is permanently or replaceably arranged sleeve-like in the interior of the arrow shaft.

To prevent the arrow from disappearing in snow, bushes or even high grass, arrowheads are known, having elongated tentacles, which are passed through holes running through the arrowhead essentially perpendicular to the flight direction or longitudinal axis of the arrow so that the opposite ends of these elongated tentacles extend oppositely from the arrowhead at an angle of essentially 90° with reference to the flight direction or longitudinal axis. In principle, such tentacles serve to ensure that the arrow comes to lie somewhat more quickly on the surface and is therefore trapped, in which case, even when an arrow penetrates a target or the ground, the tentacles brake the speed of the arrow so that it can be easily pulled out again.

Based on such tentacles passed through holes in the arrowhead, however, the braking effect is not optimal or needs further improvement, since only in the rarest cases do the tentacles support the braking effect for "trapping" over their entire length but instead only the ends of the tentacles produce a braking effect by scraping or sliding along the ground.

SUMMARY OF THE INVENTION

The task of the invention is therefore to provide an arrowhead with elongated tentacles, which significantly increases the braking effect so that an arrow equipped with them is trapped much more quickly and comes to lie on the surface or in the bushes, than with an arrowhead with elongated tentacles according to the shown prior art.

According to the invention an arrowhead is therefore provided with elongated tentacles, each of which form two ends, each tentacle being fastened with one end to the arrowhead and the other end is unsupported, in which case each tentacle, starting from the fastening to the arrowhead, leaves it in the direction of the free end of the tentacle so that an angle of ≥0° and <90°, especially angle of about 45° is formed between the tentacle and the longitudinal axis of the arrowhead in the direction of flight.

Because of the tentacles arranged almost in the fashion of a stand-up collar around the arrowhead and the tentacles therefore biased increasingly in the flight direction in contrast to biasing of the tentacles at an angle of essentially 90° with reference to the flight direction, the tentacles support the braking effect much more effectively over their entire length up to the ends when sliding along the ground so that an arrow equipped with them is trapped much more quickly and comes to lie on the surface or in the bushes than with an arrowhead with elongated tentacles according to the shown prior art.

It is prescribed in an expedient embodiment that the tentacles are each fastened in the peripheral direction of the arrowhead so that the same distance is present between the fastenings of two adjacent tentacles, the arrowhead in an additional or alternative embodiment expediently having at least three tentacles. Because of this the effect on flight behavior could be minimized and it could simultaneously be ensured that at least one tentacle always comes in contact with the ground when sliding along the ground.

It is proposed in a preferred embodiment to fasten the tentacles releasably to the arrowhead so that when the tentacles become worn only they need be replaced.

One embodiment proposes for releasable fastening to provide the arrowhead with openings for fastening of the tentacles, especially with openings pointing essentially in the flight direction, into which the fastened ends of the tentacles are inserted or screwed.

According to a preferred embodiment it is proposed that the arrowhead have an essentially cylindrical part and a sleeve that at least partially encloses the cylindrical part, in which the ends of the tentacles fastened to the arrowhead are held between the cylindrical part and sleeve for their fastening.

In a particularly simple modification the cylindrical part and/or the sleeve have grooves running essentially in the flight direction, within which the fastened ends of the tentacles are held. In addition or as an alternative the cylindrical part can have an outside thread in the area of the sleeve and the sleeve can have an inside thread meshing with the outside thread.

BRIEF DESCRIPTION OF THE DRAWINGS

Additional advantages and features of the invention are apparent from the following description of preferred embodiments with reference to the amended drawings in which.

DETAILED DESCRIPTION

Figure 1:
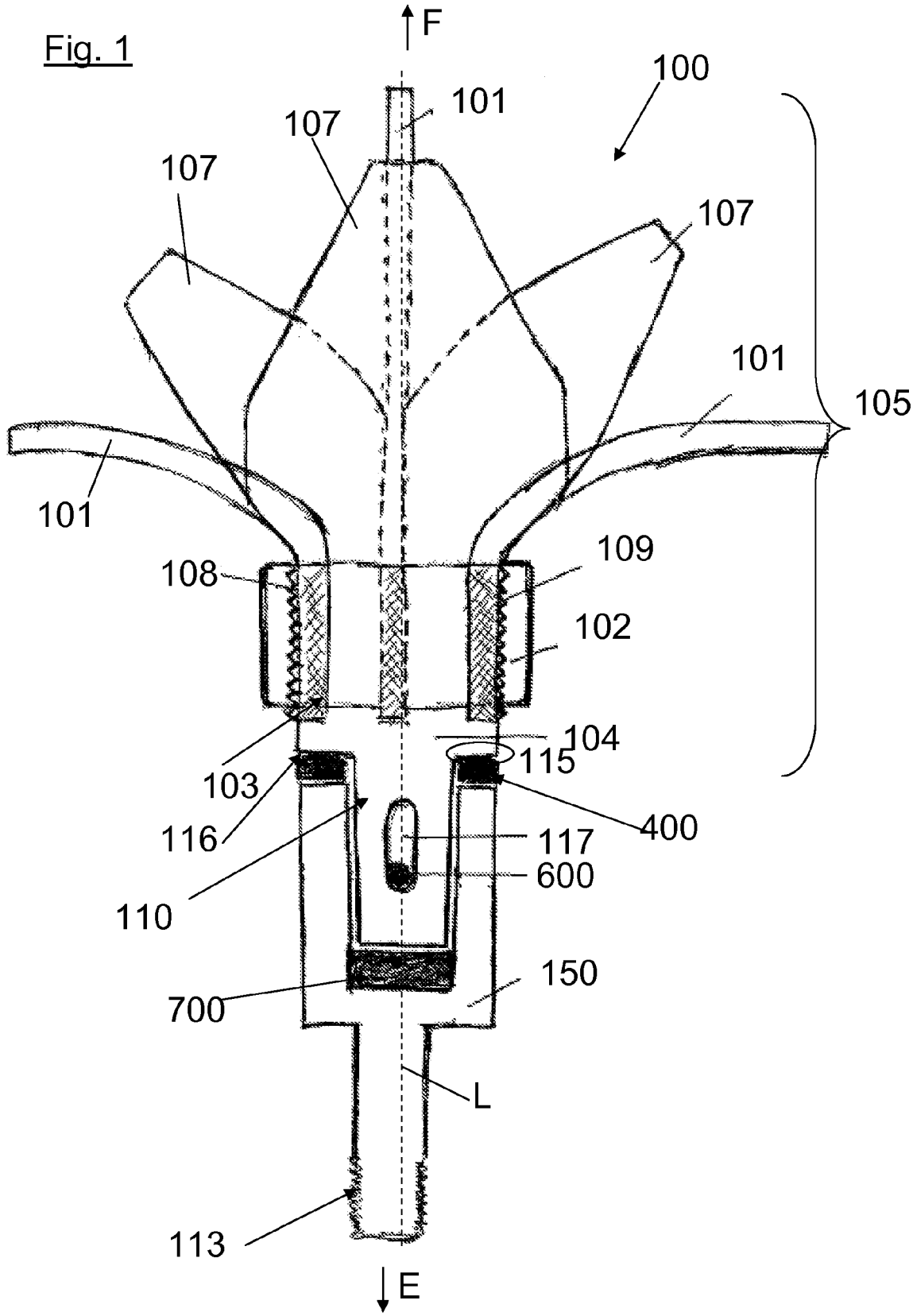
FIG. 1 shows a highly simplified, partially cutaway view of an arrowhead of a particularly preferred embodiment in the context of the invention
Figure 2:
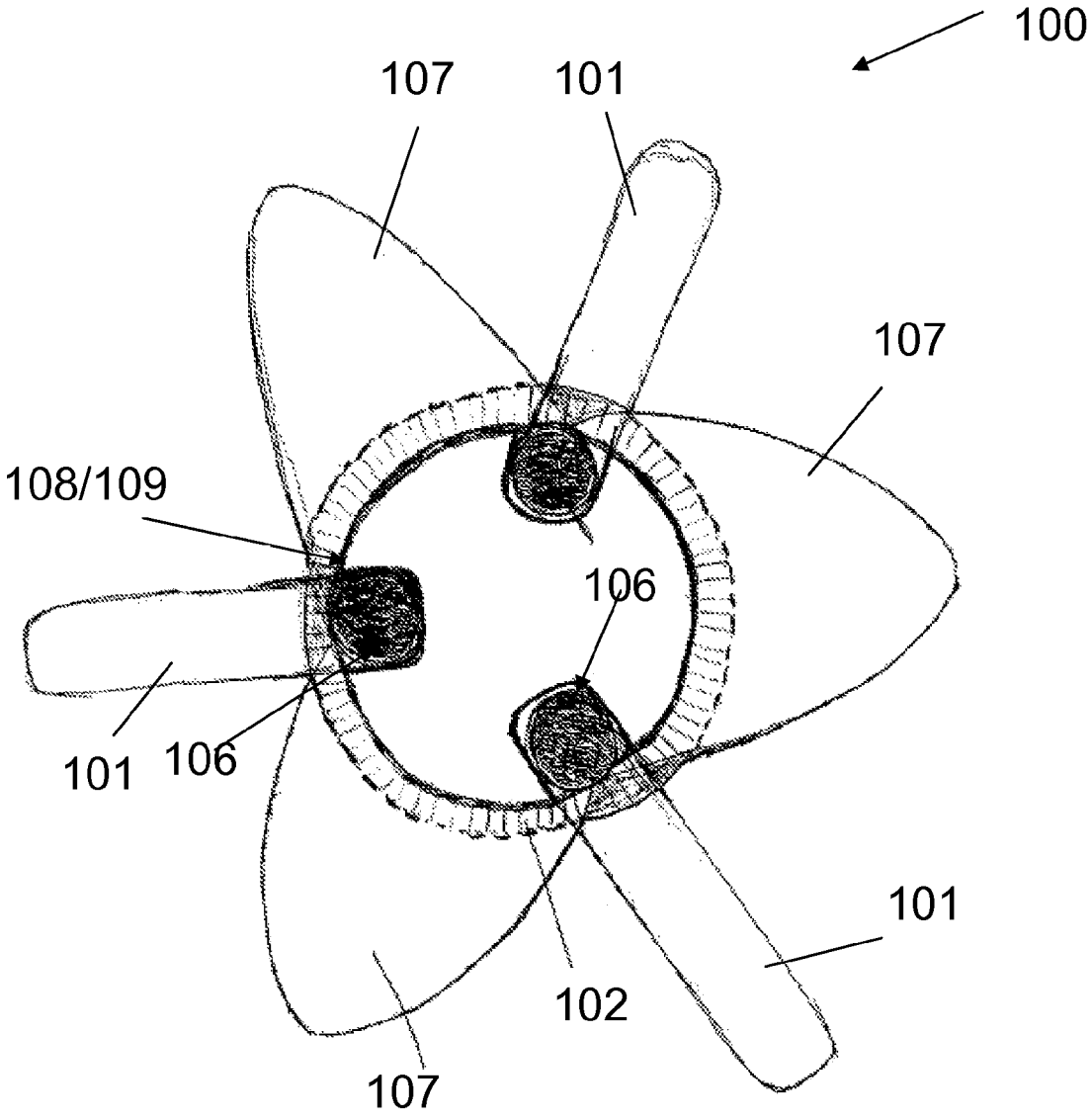
FIG. 2 shows a highly simplified sketch of an arrowhead according to FIG. 1 opposite the flight direction.

FIGS. 1 and 2 are referred to subsequently, which show in highly simplified, schematized, partially cutaway views not to scale an arrowhead 100 of a not further depicted arrow, which consists essentially of arrowhead 100 and an arrow shaft (not shown), in which the arrowhead 100 is to be inserted into the arrow shaft in the insertion direction "E", which is directed opposite flight direction "F" of an assembled arrow.

Application DE 10 2011 016 699 of the same applicant, including subsequent applications claiming its priority are fully referred to for particularly preferred types of insertion of an arrowhead into an arrow shaft.

As can be deduced from the figures, the arrowhead 100 has elongated tentacles 101, each of which forms two ends. Each tentacle 101 is fastened with one end to the arrowhead 100 and the other end of each tentacle is unsupported, in which case each tentacle 101, starting from the fastening to the arrowhead, leaves it in the direction of the free end so that an angle of ≥0° and less than 90° is formed between the longitudinal axis "L" of the arrowhead 100 in the flight direction "F" and the tentacle. It was found that an angle between 30° and 60°, i.e., around 45°, between the longitudinal axis "L" of the arrowhead 100 in the flight direction "F" and the tentacle has a particularly good effect.

The tentacles 101 in the depicted embodiment are fastened in the peripheral direction of the arrowhead so that the same distance is present between the fastening and two adjacent tentacles. The depicted embodiment also has three tentacles, in which there is also the possibility of providing the arrowheads with two or more than three tentacles.

The tentacles 101 in the depicted embodiment are also releasably fastened to the arrowhead 100.

In order to permit simple fastening of the tentacles 101 so that each tentacle 101, starting from the fastening on the arrowhead, leaves it in the direction of the free end so that an angle of ≥0° and less than 90° is formed between the longitudinal axis "L" of the arrowhead 100 in the flight direction "F" and the tentacle, the arrowhead 100 is expediently provided with openings for fastening of the tentacles, especially with openings 106 that essentially face the flight direction, into which the ends of the tentacles to be fastened are inserted or screwed. Depending on a specific alignment of openings 106, each tentacle 101 consequently leaves the arrow, starting from the fastening on the arrowhead and therefore initially the opening 106 in the direction of the free end so that an angle of ≥0° and less than 90° is formed between the longitudinal axis "L" of the arrowhead 100 in flight direction "F" and the tentacle. It is pointed out that the openings 106 can also form a single opening extending in the peripheral direction around arrowhead 100, as described subsequently.

Because of the tentacles 101 initially arranged almost in the fashion of a stand-up collar around arrowhead 100 and the tentacles 101 therefore biased in the flight direction, the tentacles support the braking effect much more effectively when sliding along the ground over their entire length up to their free ends so that an arrow equipped with them comes to lie much more quickly on the surface or in the bushes, than with an arrowhead with elongated tentacles according to the shown prior art.

For further optimization of the braking effect in a particularly preferred embodiment the elongated tentacles 101 are made from a flexible and/or reversible material. In addition or as an alternative, as can be seen in the embodiment depicted in the figures, the elongated tentacles in the unloaded state are formed arc-like, the arc shape assuming a convex arc shape when viewed from the longitudinal axis "L" of the arrowhead.

The depicted arrowhead 100 also has an essentially cylindrical part 104 and expediently a sleeve 102 that at least partially encloses this cylindrical part. The sleeve 102 serves for fastening the ends of the tentacles to be fastened to the arrowhead 100, since by means of this sleeve 102 the ends of the tentacles 101 to be fastened to the arrowhead are held in the simplest manner between the cylindrical part 104 and sleeve 102 for their fastening. For this purpose it can be sufficient after insertion of the arrowhead to simply clamp the ends of the tentacles 101 fastened to the arrowhead between the cylindrical part 104 and the sleeve 102, in which case a single slit-like opening running in the peripheral direction around arrowhead 100 is formed by the clamping area into which the ends of the tentacles being fastened are inserted for clamping.

For a further improved accommodation of the ends of the tentacles 101 being fastened, the cylindrical area 104 and/or the sleeve 102 additionally has grooves 103 running essentially in the flight direction, within which the fastened ends of the tentacles are held. In this case each groove 103, within which a fastened end of one of the tentacles 101 is held, forms the wall of an opening 106.

For simplified mounting of the sleeve 102 on the cylindrical part 104 the cylindrical part 104, at least in the area of sleeve 102, expediently has outside thread 109 and sleeve 102 has inside thread 108 meshing with the outside thread 109. Sleeve 102 therefore will be designed in the fashion of a cap nut.

The end area 107 of the arrowhead facing the flight direction is designed in the depicted embodiment in the form of hunting claws, especially in the form of three hunting claws. However, it must be pointed out that the end area facing the flight direction, in principle, can be designed in other forms, for example, with only a central tip or also with a rounded off end area. It is known to one skilled in the art that there are a variety of arrowheads with differently shaped end areas facing the flight direction, depending on the purpose.

The arrowhead 101 is also divided into a head part 105 and a body part 110 for insertion into an arrow shaft, in which case the head part 105 includes the end area 107 facing the flight direction and also the ends of the tentacles 101 fastened to the arrow shaft, which are fastened in the depicted example as head part 105. The body part 110 extends from the head part 105 in the insertion direction "E", in which it is to be inserted in the insertion direction "E" into a body part receptacle 150. The body part receptacle 150 can also form part of the arrowhead 100, as is seen in FIG. 1, which is inserted into an arrow shaft or into an insert of an arrow shaft. The body part receptacle, however, in an alternative embodiment, can also be part of an arrow shaft or an insert of an arrow shaft, as can be deduced, for example, from the application DE 10 2011 016 699 of the same applicant, including subsequent applications claiming its priority, which are referred to in this respect.

The arrowhead depicted in the figures is also expediently designed to form an arrow damping system, which has an effect as described subsequently in the inserted state of the arrowhead 100 in an arrow shaft.

As prescribed in the referred to applications DE 10 2011 016 699 of the same applicant, including subsequent applications claiming its priority, to form the arrow damping system it is preferably prescribed that it enclose the arrowhead 100, in which case the transitional region between the head part 105 and the body part 110 is provided by an undercut 115 running across the insertion direction and forms an annular contact surface 116 directed in the insertion direction. In the depicted example the contact surface is designed flat and essentially perpendicular to the insertion direction "E", but need not be flat and/or can also merely run transversely.

A ring 400 made of damping material guided or positioned around body part 110 lies against the contact surface 116. The body part 110 also has an external shaping along and across the insertion direction that matches the body part receptacle 150 so that in the inserted state of body part 110 in the body part receptacle 150, as shown, on the one hand, the ring 400 made of damping material lying against the contact surface 116 of head part 105 is situated between head part 105 and body part receptacle 150 and, on the other hand, a sliding support acting along the insertion direction is produced between body part 110 and body part receptacle 150 so that, when a force directed back into the arrow is exerted, i.e., a force directed essentially in the insertion direction, the arrowhead 100 can enter the body part receptacle 150 through ring 400 of the body part 110.

Depending on the application, essentially all damping materials can be used for the damping ring to exert the forces, in which case an elastic, especially spring-elastic damping material is preferably used. The damping properties of the employed material also dictate the minimal insertion depth to be guaranteed.

For insertion of the body part 110 into the body part receptacle 150, after the ring 400 has been positioned around the body part 110, and to produce the sliding support acting along the insertion direction, the body part receptacle 150 of the embodiment depicted in FIG. 1 in the area of the body part 110 includes a through hole passed through the body part receptacle across the insertion direction, which cannot be seen in FIG. 1, and the body part 110 likewise has a through-hole 117 leading through the body part aligned with the through-hole formed in the body part receptacle. A through-pin 600 extends through both through-holes, which is dimensioned to be held in the through-holes. Either the through-hole formed in the body part receptacles or, as in the embodiment according to FIG. 1, the through-hole 117 formed in the body part is designed as an elongated hole extending opposite the insertion direction so that the through-pin 600 is fasted opposite the insertion direction only in the through-hole that is not formed as an elongated hole, i.e., according to FIG. 1 in the through-hole formed in the body part receptacle 150 (but not shown).

Since only the through-hole 117 designed as an elongated hole consequently has a greater extent opposite the insertion direction than the other through-hole not designed as an elongated hole and the through-pin extending through both elongated holes, the arrowhead 100 can enter the body part receptacle 150 when a force directed back into the arrow is exerted, i.e., a force directed essentially in the insertion direction, through ring 400 of the back part 110. Otherwise the outer shaping of the body part 110 is preferably adapted to that of the body part receptacle 150 so that both enter into a sliding fit or press fit in the inserted state.

To further increase the damping properties according to the embodiment of FIG. 1 a second damping material 700 is also arranged within the body part receptacle 150, on which the body part 110 can be supported in the insertion direction into the body part receptacle 150.

The second damping material and its damping properties can be according to those described with reference to the damping material of ring 400.

The body part receptacle 150 of the embodiment depicted in FIG. 1 also has an outside thread 113 so that the arrow shaft (not shown) or an (additional) insert arranged in it for insertion of the arrowhead 100 has a corresponding inside thread. As an alternative, with sufficient wall thickness of the arrow shaft the body part receptacle can also be directly furnished by the arrow shaft or an insert arranged in the arrow shaft.

To summarize, the embodiment of an arrowhead described above and depicted in FIG. 1 in the context of the invention is especially suited for use as a hunting tip for small game and as a training tip during roving, i.e., during shooting outdoors at natural targets, like tree stumps, bushes, leaves, mushrooms, etc. or stamp shooting, i.e., in a type of free training in which everything encountered is shot at. The arrowhead has rigid aggressive trapping claws 107, for example, made of steel and offers an extreme stopping effect on encountering hard targets. The flexible replaceable tentacles 101 also produce much more effective braking and stopping in bushes, shrubs, ground plants and snow. The integrated shock damping also protects the arrow shaft and therefore significantly extends its lifetime.

LIST OF REFERENCE NUMBERS

100 Arrowhead
101 Tentacles
102 Sleeve
103 Groove
104 Cylindrical part
105 Head part
106 Openings
107 End area of the arrowhead facing the flight direction
108 Inside thread
109 Outside thread
110 Body part
113 Outside thread
115 Undercut
116 Contact surface
117 Through-hole design as elongated hole
150 Body part receptacle
400 Ring made of damping material
600 Through-pin
700 Second damping material
E Insertion direction
F Flight direction
L Longitudinal axis

What is claimed is:

1. An arrowhead with elongated tentacles, each of which forms two ends, each tentacle with one end being fastened to the arrowhead and the other end being unsupported and in which each tentacle, starting from the fastening on the arrowhead, leaves it in the direction of the free end so that an angle of ≥0° and less than 90° is formed between a longitudinal axis of the arrowhead in the flight direction and the tentacle, wherein the arrowhead has an essentially cylindrical part and a sleeve at least partially enclosing the cylindrical part, and wherein the ends of the tentacles fastened to the arrowhead are held between the cylindrical part and the sleeve for their fastening.

2. The arrowhead according to claim 1, wherein the tentacles are fastened in a peripheral direction of the arrowhead so that the same distance is present between the fastenings of two adjacent tentacles.

3. The arrowhead according to claim 1, wherein the arrowhead has at least three tentacles.

4. The arrowhead according to claim 1, wherein the tentacles are releasably fastened to the arrowhead.

5. The arrowhead according to claim 1, wherein the arrowhead is provided for fastening the tentacles with openings.

6. The arrowhead according to claim 5, wherein the openings are essentially facing the flight direction, into which the ends of the tentacles are inserted or screwed.

7. The arrowhead according to claim 1, wherein at least one of the cylindrical part and the sleeve has grooves running essentially in the flight direction, within which the fastened ends of the tentacles are held.

8. The arrowhead according to claim 1, wherein the cylindrical part has outside tread in an area of the sleeve and the sleeve has inside thread meshing with the outside thread.

9. The arrowhead according to claim 1, wherein the tentacles are made from at least one of flexible material and reversible material.

10. The arrowhead according to claim 1, wherein the elongated tentacles in the unloaded state are arc-shaped, the arc shape assuming a convex arc shape when viewed from the longitudinal axis of the arrowhead.

11. An arrowhead with elongated tentacles, each of which forms two ends, each tentacle with one end being fastened to the arrowhead and the other end being unsupported and in which each tentacle, starting from the fastening on the arrowhead, leaves it in the direction of the free end so that an angle of ≥0° and less than 90° is formed between a longitudinal axis of the arrowhead in the flight direction and the tentacle, wherein the elongated tentacles in the unloaded state are arc-shaped, the arc shape assuming a convex arc shape when viewed from the longitudinal axis of the arrowhead.

12. The arrowhead according to claim 11, wherein the tentacles are fastened in a peripheral direction of the arrowhead so that the same distance is present between the fastenings of two adjacent tentacles.

13. The arrowhead according to claim 11, wherein the arrowhead has at least three tentacles.

14. The arrowhead according to claim 11, wherein the tentacles are releasably fastened to the arrowhead.

15. The arrowhead according to claim 11, wherein the arrowhead is provided for fastening the tentacles with openings.

16. The arrowhead according to claim 15, wherein the openings are essentially facing the flight direction, into which the ends of the tentacles are inserted or screwed.

17. The arrowhead according to claim 11, wherein the arrowhead has an essentially cylindrical part and a sleeve at least partially enclosing the cylindrical part, and wherein the ends of the tentacles fastened to the arrowhead are held between the cylindrical part and the sleeve for their fastening, and wherein at least one of the cylindrical part and the sleeve has grooves running essentially in the flight direction, within which the fastened ends of the tentacles are held.

18. The arrowhead according to claim 11, wherein the arrowhead has an essentially cylindrical part and a sleeve at least partially enclosing the cylindrical part, and wherein the ends of the tentacles fastened to the arrowhead are held between the cylindrical part and the sleeve for their fastening, and wherein the cylindrical part has outside tread in an area of the sleeve and the sleeve has inside thread meshing with the outside thread.

19. The arrowhead according to claim 11, wherein the tentacles are made from at least one of flexible material and reversible material.

* * * * *